US006944419B2

(12) United States Patent
Kawamoto et al.

(10) Patent No.: US 6,944,419 B2
(45) Date of Patent: Sep. 13, 2005

(54) IMAGE FORMING APPARATUS AND CONTROL METHOD FOR THE SAME

(75) Inventors: Kiyoaki Kawamoto, Tokyo (JP); Hideaki Tanaka, Tokyo (JP); Shinichi Tsukamura, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/445,630

(22) Filed: May 27, 2003

(65) Prior Publication Data

US 2003/0223790 A1 Dec. 4, 2003

(30) Foreign Application Priority Data

May 29, 2002 (JP) ..... 2002-155389

(51) Int. Cl.[7] ..... G03G 15/20; G03G 21/00

(52) U.S. Cl. ..... 399/327; 399/71; 399/328; 399/333; 492/56

(58) Field of Search ..... 399/327, 326, 399/325, 71, 328, 329, 352, 333; 430/124; 15/256.5, 256.6; 492/49, 53, 56

(56) References Cited

U.S. PATENT DOCUMENTS 4,557,588 A * 12/1985 Tomosada ..... 399/352
4,908,898 A * 3/1990 Kubo ..... 492/56
5,195,430 A * 3/1993 Rise ..... 492/56
5,465,146 A * 11/1995 Higashi et al. ..... 399/328
5,953,039 A * 9/1999 Boutet et al. ..... 399/328
5,970,298 A * 10/1999 Seki et al. ..... 399/327
6,383,703 B1 * 5/2002 Asano et al. ..... 430/108.1
6,427,060 B1 * 7/2002 Arakawa et al. ..... 399/327
6,652,433 B1 * 11/2003 Ishikawa et al. ..... 492/56
2003/0210934 A1 * 11/2003 Matsumoto ..... 399/326

FOREIGN PATENT DOCUMENTS

JP 08-087194 * 4/1996
JP 11-095600 * 4/1999
JP 2003/005562 * 1/2003

* cited by examiner

*Primary Examiner*—Sophia S. Chen
(74) *Attorney, Agent, or Firm*—Frishauf, Holtz, Goodman & Chick, P.C.

(57) ABSTRACT

An electrophotographic image forming apparatus includes a fixing unit having a heat roller and a press roller which abuts against and presses the heat roller. The image forming apparatus further includes at least one cleaning unit including a backup roller which abuts against and presses the heat roller in order to remove remaining toner attaching to a surface of the heat roller. The backup roller has a two-layer structure of a metal shaft core and a resilient layer, as an outer layer for the shaft core, made of a resilient body. The diameter of the backup roller gradually reduces from a projecting axial center of 10 mm to 30 mm toward two axial ends, so that an entire outer shape of the backup roller forms a crown or spindle like shape.

14 Claims, 4 Drawing Sheets

IMAGE FORMING APPARATUS AND CONTROL METHOD FOR THE SAME

BACKGROUND OF THE INVENTION

1. Field of the Invention

The present invention relates to a heat roller type fixing unit in an image forming apparatus, and a control method for the same.

2. Description of the Related Art

In a heat roller type fixing unit in an image forming apparatus such as a copying machine, printer, facsimile apparatus, or the like, a cleaning web scheme is conventionally, generally employed as a cleaning means for removing toner remaining on the surface of a heat roller. This scheme is recognized as an effective technique because it can remove the remaining toner on the surface of the heat roller with a high efficiency and because it can be employed together with the function of applying a releasing agent such as silicone oil on the surface of the heat roller.

Where the cleaning web is in contact with the heat roller, however, the cleaning web is pulled by the frictional force or attracting force of the rotating heat roller. Sometimes the cleaning web is undesirably pulled out from the take-up shaft or feed shaft and reaches a transfer sheet feed path. Consequently, this scheme has a drawback in that inconveniences such as paper jamming may occur.

To prevent this, the feed shaft is braked in advance, so the web is prevented from being pulled out undesirably.

In this case, a driving force equal to or larger than the braking force of the feed shaft is required as a driving torque for the take-up shaft, and a very large tension acts on the cleaning web between the take-up shaft and the feed shaft. The tension of the web pulls a backup roller. Then, the backup roller disposed between the take-up and feed rollers acts in a direction to reduce the pressure on the heat roller. In particular, the axial center of the backup roller sometimes flexes undesirably in a direction to separate from the surface of the heat roller.

Generally, regarding the cleaning of the remaining toner with the cleaning web, the cleaning web which is conveyed between the backup roller and the heat roller while being pressed rubs against the heat roller with a predetermined pressure and nip width, so it cleans the remaining toner attaching to the heat roller.

When the backup roller and heat roller come into contact with each other, the resilient layer of the backup roller is depressed by the heat roller. A nip refers to a tight-contact region of the contact portion of the backup roller and heat roller. The tight-contact region usually has a rectangular shape (pattern) and changes into a drum-like shape or bobbin-like shape depending on the flexure of the shaft of the backup roller or the like. The nip width refers to the width of the nip in a direction parallel to the convey direction of the cleaning web.

When the backup roller flexes, the nip width enlarges at its two ends and narrows considerably at its center.

This leads to the following drawbacks. As the center of the backup roller has a small nip width and accordingly does not have a sufficiently large pressure, the remaining toner attaching to the heat roller does not attach to the cleaning web but may pass by under it. At the ends of the backup roller, the nip width is excessively large with respect to the take-up amount of the cleaning web, and accordingly that portion of the cleaning web where the remaining toner attaches cannot be taken up and recovered, but the toner which attaches to the cleaning web once may be discharged again.

SUMMARY OF THE INVENTION

The present invention has been made in view of the above problems, and has as its object to provide an image forming apparatus with which even if the backup roller flexes in its axial direction due to the tension of the web, a uniform nip width can be obtained between the backup roller and the heat roller.

In order to achieve the above object, according to the first aspect of the present invention, there is provided an electrophotographic image forming apparatus comprising fixing means having a heat roller and a press roller which abuts against and presses the heat roller, wherein the apparatus further comprises at least one cleaning means having a backup roller which abuts against and presses the heat roller in order to remove remaining toner attaching to a surface of the heat roller, and the backup roller has a two-layer structure of a metal shaft core and a resilient layer, as an outer layer for the shaft core, made of a resilient body, a diameter of the backup roller gradually decreasing from a projecting axial center of 10 mm to 30 mm toward two axial ends, so that an entire outer shape of the backup roller forms a crown- or spindle-like shape.

According to the second aspect of the present invention, there is provided an image forming apparatus wherein the shaft core of the backup roller according to the first aspect is a circular cylindrical shaft with a diameter of 5 mm to 15 mm which is made of iron, SUS (stainless steel), or aluminum, and the resilient layer of the backup roller according to the first aspect is made of a resilient body containing silicone foamed rubber and having a surface roughness Ra of 20 $\mu$m to 80 $\mu$m, a hardness of 10 to 40 degrees (Asker C hardness), and a thickness of 3 mm to 20 mm, such that a thickness of the resilient layer around the shaft core is uniform in a direction of diameter, and is large at the axial center and gradually decreases toward the two axial ends in an axial direction, so a difference t in thickness between the axial center and the two axial ends is 0.05 mm to 1 mm.

According to the third aspect of the present invention, there is provided an image forming apparatus wherein the shaft core of the backup roller according to the first aspect is made iron, SUS (stainless steel, or aluminum, a diameter of the shaft core gradually decreasing from the projecting axial center of 5 mm to 15 mm toward the two axial ends, to form a crown- or spindle-like shape with a difference in diameter between the axial center and the two axial ends of 0.1 mm to 2 mm, and the resilient layer of the backup roller according to the first aspect is made of a resilient body containing silicone foamed rubber and having a surface roughness Ra of 20 $\mu$m to 80 $\mu$m, a hardness of 10 to 40 degrees (Asker C hardness), and a thickness of 3 mm to 20 mm, such that a thickness of the resilient layer is uniform both in a direction of diameter and in an axial direction.

According to the fourth aspect of the present invention, there is provided an image forming apparatus wherein the cleaning means according to the first aspect comprises a cleaning web conveyed between the backup roller and the heat roller to come into slidable contact therewith, in order to remove remaining toner attaching to the surface of the heat roller, feed means for supplying the cleaning web, and take-up means for recovering the cleaning web, the cleaning web comprising a ribbon-like web made of fibers including an aramid fiber, and the feed means being connected to a brake which generates a braking force of 4 N to 15 N for the cleaning web.

According to the fifth aspect of the present invention, there is provided an image forming apparatus wherein the backup roller and the heat roller according to the first aspect are disposed at such an axis-to-axis distance from each other that a nip width formed when the backup roller and the heat roller abut against each other is 1 mm to 6 mm.

According to the sixth aspect of the present invention, there is provided an image forming apparatus wherein an outermost layer of the heat roller according to the first aspect is formed of a fluoroplastic coating layer containing a copolymer (PFA) of tetrafluoroethylene and perfluoroalkyl vinyl ether and polytetrafluoroethylene (PTFE) and has a surface roughness Ra of 0.1 $\mu$m to 0.8 $\mu$m and an undulation amount WCM of 1 $\mu$m to 3.5 $\mu$m.

According to the seventh aspect of the present invention, there is provided an image forming apparatus wherein the heat roller and the backup roller according to the first aspect rub against the cleaning web with a peripheral velocity of 150 mm/sec to 400 mm/sec.

According to the eighth aspect of the present invention, there is provided an image forming apparatus wherein powder toner used in the image forming apparatus according to the first aspect contains a thermoplastic styrene-acrylic resin having an average particle size of not more than 7 $\mu$m as a main component.

According to the ninth aspect of the present invention, there is provided an electrophotographic image forming apparatus comprising fixing means having a heat roller and a press roller which abuts against and presses the heat roller, and control means, wherein the apparatus further comprises at least one cleaning means having a backup roller which abuts against and presses the heat roller in order to remove remaining toner attaching to a surface of the heat roller, the backup roller has a two-layer structure of a metal shaft core with a diameter of 5 mm to 15 mm and a resilient layer, as an outer layer for the shaft core, made of a resilient body containing foamed rubber, the resilient layer having a hardness of 10 to 40 degree (measured by an Asker C hardness meter) and a surface roughness Ra of 20 $\mu$m to 80 $\mu$m, a diameter of the backup roller gradually decreasing from a projecting axial center of 10 mm to 30 mm toward two axial ends, so that an entire outer shape of the backup roller forms a crown- or spindle-like shape with a difference in diameter between the axial center and the two axial ends of 0.1 mm to 2 mm, and the cleaning means comprises a ribbon-like cleaning web which is made of fibers including an aramid fiber and conveyed between the backup roller and the heat roller to come into slidable contact therewith under a pressure in order to scrape off the remaining toner attaching to the heat roller, feed means for supplying the cleaning web, and takeup means driven by driving means controlled by the control means to recover the cleaning web, the driving means being controlled by the control means to generate a winding force of 8 N to not less than 30 N, when the heat roller rotates in a forward direction, in a direction opposite to a rotating direction of the heat roller in accordance with a cleaning web width.

According to the tenth aspect of the present invention, there is provided an image forming apparatus wherein the control means according to the ninth aspect controls the driving means such that the cleaning web is conveyed for 0.02 mm to 0.08 mm whenever a piece of recording medium is conveyed.

As is apparent from the above aspects, according to the present invention, the following effects can be obtained. More specifically, in the removing means for removing remaining toner on the cleaning web type heat roller or the like, when a tension is applied to the cleaning web, even if the backup roller flexes, a uniform nip width can be obtained between the backup roller and the heat roller, so that an image print free from toner contamination can be obtained.

DETAILED DESCRIPTION OF THE PREFERRED EMBODIMENT

The present invention will be described by way of several preferable embodiments with reference to the accompanying drawings. Note that the present invention is not limited to these embodiments.

First, the outline of an image forming apparatus according to the present invention will be described with reference to FIGS. 1 and 2.

Figure 1:
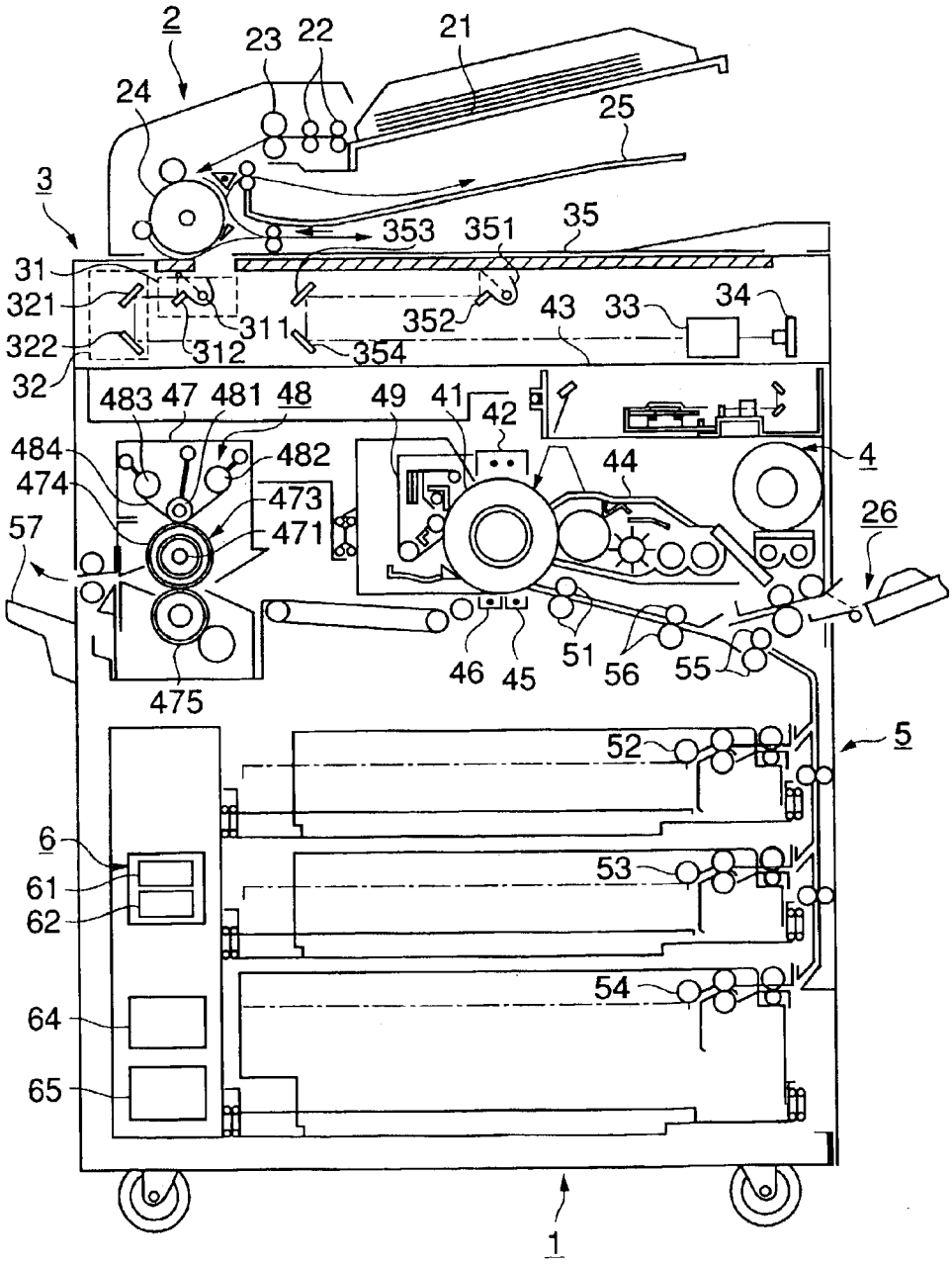
FIG. 1 is a longitudinal sectional view showing a general schematic overall arrangement of an image forming apparatus.

Referring to FIG. 1, reference numeral 1 denotes an image forming apparatus. Documents are placed on a document feed table 21 of an automatic document feeder 2 with their image surfaces facing up, are fed one by one by the operation of feed rollers 22, and are stopped temporarily by registration rollers 23 so their leading edges are aligned. After that, each document is conveyed to a convey drum 24, and its image surface is read by an image reading section 3 while it rotates together with the drum surface counterclockwise. When the document rotates through a substantially half turn, it is separated from the drum surface and is delivered to a delivery table 25.

In the image reading section 3, a first mirror unit 31 having a light source 311 and mirror 312 sequentially illuminates a passing document image immediately under the convey drum 24, and reads it. The read image is reflected by a second mirror unit 32 having mirrors 321 and 322 arranged to be perpendicular to the moving direction of the document, and forms an image on a linear sensing element 34 through an image forming lens 33.

When reading image information from a document placed on a platen glass plate 35, the image is reflected by a first mirror unit having a movable light source 351 and a first mirror 352, and a second mirror unit having mirrors 353 and 354, and forms an image on the linear sensing element 34 through the image forming lens 33.

The image information of the document read by the image reading section 3 is subjected to an image process by an image processor 62 of a controller 6, so it is converted into image data signals and temporarily stored in a storage section 61.

At the start of image formation, when an image forming section 4 starts its operation, the image data is read out from the storage section 61 and input to an image writing section 43. In accordance with the image data, a laser beam emitted from a laser light-emitting device (not shown) exposes a photosensitive drum 41, to which a potential is applied in advance by a charging device 42, by main scanning in the axial direction of the photosensitive drum 41 through rotation of a polygon mirror (with no reference numeral) and subscanning through rotation of the photosensitive drum 41. Thus, the electrostatic latent image of the document image is formed on the photosensitive layer of the photosensitive drum 41. The electrostatic latent image is inverted and developed by a developing section 44, to form a toner image of the photosensitive drum 41.

Along with this development, a manual sheet feeding section 26 serving as a recording sheet supply means, or either one of feed rollers 52, 53, and 54 of the respective sheet feeding cassettes of a sheet feeding section 5 which stores recording media (the recording media will be referred to as recording sheets hereinafter) is actuated to feed a recording sheet.

Successively, the recording sheet is fed to the photosensitive drum 41 through convey rollers 55 and 56 and timing rollers 51 in synchronism with the formation of the toner image on the photosensitive drum 41.

The toner image on the photosensitive drum 41 is transferred to the recording sheet when a voltage with an opposite polarity to that of the toner image is applied to it by a transfer device 45. The recording sheet bearing the toner image is discharged by a discharging device 46 and is separated from the photosensitive drum 41. The separated recording sheet is conveyed to a fixing unit 47, and is heated and pressed by a heat roller 474 and press roller 475, so the toner is fused and fixed on the recording sheet. After the image is fixed, the recording sheet is delivered to a tray 57.

The remaining potential is removed from the photosensitive drum 41 from which the recording sheet has been separated, and the remaining toner on the photosensitive drum 41 is removed and cleaned by a photoreceptor cleaning unit 49, so the photosensitive drum 41 prepares for the next image formation process.

A fixing temperature sensor 473 such as a thermistor or thermocouple for detecting the surface temperature of the heat roller 474 in a non-contact manner is attached at a small distance (e.g., 0.7 mm) from the heat roller 474. The temperature of the heat roller 474 is controlled by the controller 6 on the basis of a detection output from the fixing temperature sensor 473.

An outline of the image forming apparatus has been described so far. The fixing unit will now be described in detail with reference to FIGS. 1 and 2.

The fixing unit 47 is formed of the heat roller 474, press roller 475, and cleaning unit 48.

The heat roller 474 incorporates a halogen lamp 471, serving as a heater for heating the heat roller 474, inside an aluminum circular cylindrical base, and has a heat-resistant releasing layer (with no reference numeral) made of, e.g., fluoroplastic, as an outer layer for the aluminum circular cylindrical base.

The press roller 475 has a heat-resistant resilient layer (with no reference numeral) made of, e.g., silicone rubber, as an outer layer for an aluminum base, and is abutted against the heat roller 474 as it is pressed by a pressing means (not shown).

The cleaning unit 48 is constituted by a backup roller 481 disposed in contact with the heat roller 474 to be parallel to it, a cleaning web 484 for removing the remaining toner on the heat roller 474, a feed section (supply side) 482 for supplying the cleaning web 484, and a take-up section 483.

Figure 6:
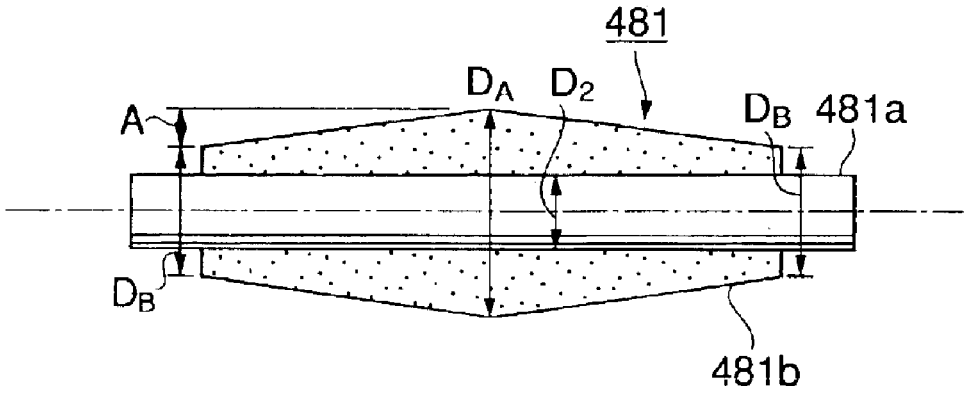
FIG. 6 is a conceptual view of the first example of the backup roller according to the present invention in which its center projects.

FIG. 6 shows the first example of the backup roller 481 according to the present invention, whose axial center projects. According to this example, ① The backup roller 481 forms a two-layer structure of a metal shaft core 481*a* and a resilient layer 481*b* serving as an outer layer and made of a resilient body. The diameter of the backup roller 481 gradually decreases from its projecting axial center toward its two axial ends, such that the difference between a diameter $D_A$ (10 mm to 30 mm) of the axial center and a diameter $D_B$ of the two axial ends is 0.1 mm to 2 mm.

② The shaft core 481*a* is formed of a circular cylindrical shaft with a diameter of 5 mm to 15 mm which is made of iron, SUS (sus, i.e., stainless steel), or aluminum.

③ The resilient layer 481*b* is made of a resilient body containing silicone foamed rubber and having a surface roughness Ra of 20 $\mu$m to 80 $\mu$m, a hardness of 10 to 40 degrees (Asker C hardness), and a thickness of 3 mm to 20 mm, such that its thickness around the shaft core is uniform in the direction of diameter, and is large at the axial center and gradually decreases toward the two axial ends in the axial direction, so a difference t in thickness between the center and the two ends is 0.05 mm to 1 mm.

④ The entire outer shape of the backup roller 481 forms a crown- or spindle-like shape.

Figure 7:
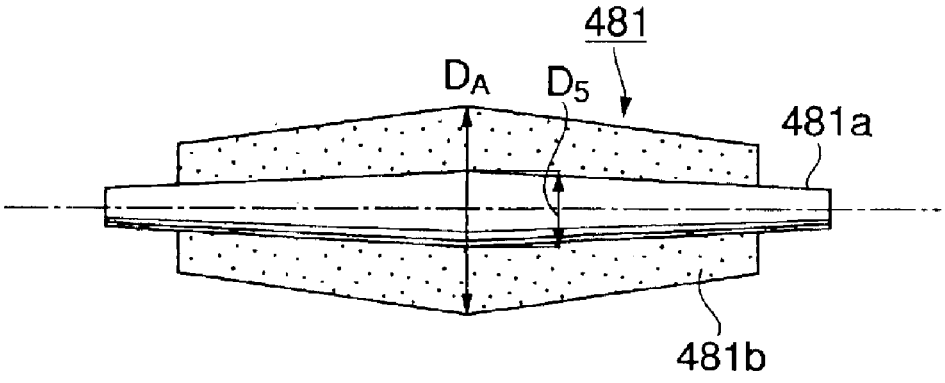
FIG. 7 is a conceptual view of the second example of the backup roller according to the present invention in which its center projects.

FIG. 7 shows the second example of the backup roller 481 according to the present invention, whose center projects. According to the example shown in FIG. 7, ① The outer shape of the entire backup roller 481 is similar to that of the first example shown in FIG. 6.

② A shaft core 481*a* has a diameter $D_5$ of 5 mm to 15 mm and is made of a metal (iron, SUS, or aluminum) such that its thickness is large at its axial center and gradually decreases toward its two axial ends, so the section of the shaft core 481*a* taken along the axial direction forms a crown- or spindle-like shape with a difference in diameter between the axial center and the two axial ends of 0.1 mm to 2 mm.

③ A resilient layer 481*b* is made of the same material and has the same surface roughness as those of the first example shown in FIG. 6, and has a substantially uniform thickness in the axial direction.

④ When a diameter $D_A$ at the center of the backup roller 481 is 10 mm to 30 mm, the difference in diameter between the axial center and the two axial ends is 0.1 mm to 2 mm.

The backup roller 481 and heat roller 474 are disposed parallel to each other at such an axis-to-axis distance from each other that the resilient layer 481*b* of the backup roller 481 is squeezed by the heat roller 474 so the nip width (of the cleaning web 484) becomes 1 mm to 6 mm. The stress occurring when the resilient layer 481*b* is squeezed serves as a pressure the cleaning web 484 exerts on the heat roller 474.

A load may be applied to the backup roller 481 by a press means (not shown) such that the nip width is 1 mm to 6 mm, as described above.

The cleaning web 484 is made of fibers including an aramid fiber and has a ribbon-like shape. The cleaning web 484 is supplied from the feed section (original winding) 482, is conveyed between the backup roller 481 and heat roller 474 under pressure to be in slidable contact with them, and rubs against the heat roller 474, rotating at a peripheral velocity of 150 mm/sec to 400 mm/sec, at the contact portion of the backup roller 481 and heat roller 474, to remove the remaining toner on the heat roller 474. The cleaning web 484 to which the toner has attached is taken up by the take-up section 483 and recovered.

The take-up section 483 is connected to a take-up shaft 485 and a take-up motor 486 serving as a driving means which is connected to the take-up shaft 485 directly or through a reducing means (not shown). The take-up section 483 takes up and recovers the cleaning web 484.

Reference numeral 489 denotes a web convey amount detector. The web convey amount detector 489 is connected to the backup roller 481 and detects the convey amount of the cleaning web 484 at the contact portion of the backup roller 481 and heat roller 474. The detected convey amount information is input to the controller 6. The convey amount of the cleaning web 484 is controlled on the basis of this information.

During the copy operation, the take-up motor 486 may be continuously rotated, so the cleaning web 484 is conveyed for 0.02 mm to 0.08 mm each time one recording sheet is conveyed.

The feed section 482 is connected to a brake 488 which generates a braking force (tensile load) $f_B$ of 4 N to 15 N through a bias shaft 487, so the cleaning web 484 which is fed will not slack when the heat roller 474 rotates in the reverse direction.

Alternatively, the feed section 482 may be constantly braked slightly by using an electromagnetic brake or the like instead of the brake 488 described above, so that a braking force $f_B$ of approximately 4 N to 15 N may be applied to the cleaning web 484 only when the heat roller 474 rotates in the reverse direction.

According to still another example, in addition to a cleaning unit with the same arrangement described above for removing the remaining toner on the heat roller, a second cleaning unit based on the same idea as that of the cleaning unit may be provided for removing the remaining toner on the press roller.

Figure 3:
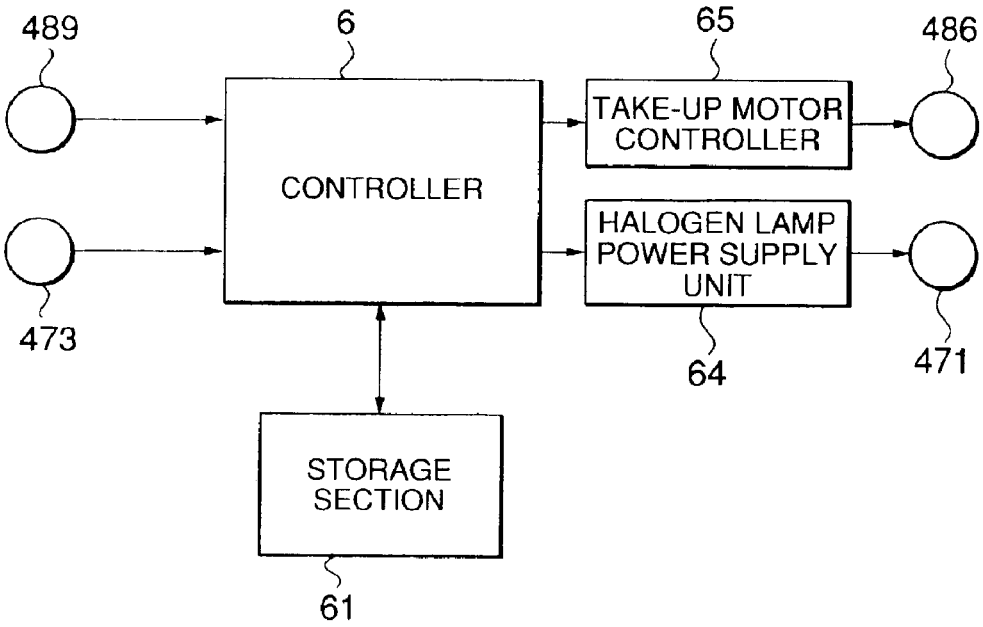
FIG. 3 is a control block diagram of the fixing unit shown in FIG. 2.

An outline of the image forming apparatus has been described so far. The control operation of the fixing unit 47 will now be described with reference to FIG. 3.

Reference numeral 473 denotes the fixing temperature sensor. An output from the fixing temperature sensor 473 is input to the controller 6 together with an output from the web convey amount detector 489.

Reference numeral 486 denotes the take-up motor for the cleaning web 484. The take-up motor 486 is connected to the output of the controller 6 through a take-up motor controller 65, and performs the control operation to be described later.

Reference numeral 471 denotes the halogen lamp serving as a heater for heating the heat roller 474. The halogen lamp 471 is connected to the output of the controller 6 through a halogen lamp power supply unit 64, and performs the control operation to be described later.

The controller 6 performs control operation concerning a generally performed image formation process, and reads the states of the respective input devices described above, to control the respective output devices (described above) on the basis of a control program stored in advance in the storage section 61.

Figure 2:
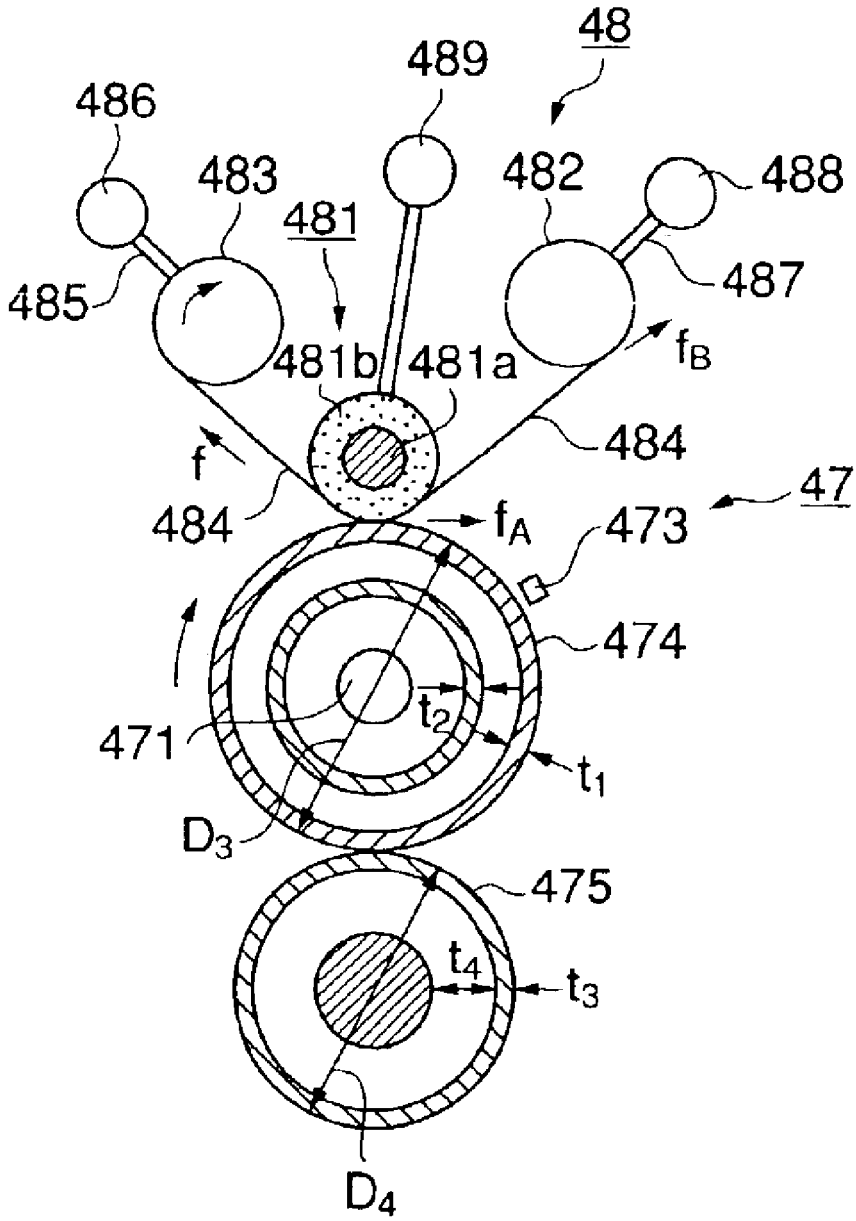
FIG. 2 is a schematic view of a fixing unit in the image forming apparatus shown in FIG. 1.

For example, each time a recording sheet is copied (each time one recording sheet is conveyed), the controller 6 rotationally drives the take-up motor 486 so the takeup section 483 rotates in the direction of an arrow shown in FIG. 2. More specifically, the controller 6 reads the convey amount of the cleaning web 484 input from the web convey amount detector 489, and controls the take-up motor 486 as the driving means, to take up the cleaning web 484 by 0.02 mm to 0.08 mm each time one recording sheet is conveyed in accordance with the size of the recording sheet.

The cleaning web 484 may be taken up either at the start of feeding the recording sheet, during conveyance of the recording sheet, during formation of an image onto the photosensitive body, during transfer and separation, or fixing, and is preferably taken up during formation of an image onto the photosensitive body, so that the take-up time can have a margin.

When taking up the cleaning web 484, a force f (tensile load) equivalent to the sum of the braking force $f_B$ of the brake 488 (described above) and a frictional force $f_A$ between the heat roller 474 and cleaning web 484 acts on the cleaning web 484 between the take-up section 483 and backup roller 481. Thus, the take-up motor 486 takes up the cleaning web 484 with a torque equal to or larger than the force f, e.g., with a take-up force (tensile load) of 8 N to 30 N or more in accordance with the width of the cleaning web 484.

Furthermore, the controller 6 constantly monitors the fixing temperature sensor 473, and controls power supply to the halogen lamp 471, so the surface temperature of the heat roller 474 is approximately 190° C.

Concerning the fixing unit, a test was performed about the state of occurrence of an abnormality in the contact width (nip width) of the heat roller 474 and press roller 475. Arrangements and conditions with which the test was performed will be described.

The arrangements and conditions employed in the test will be described with reference to FIGS. 2, 4, 5, 6, and 7.

Note that the heat roller 474 of FIG. 2 has a diameter $D_3$ of 50 mm, a surface layer coating thickness $t_1$ of 20 $\mu$m, a core metal thickness $t_2$ of 9 mm (aluminum), and an entire length of 350 mm, and that the press roller 475 has a diameter $D_4$ of 50 mm, a surface layer tube thickness $t_3$ of 70 $\mu$m, and a resilient layer thickness $t_4$ of 5 mm.

The 900-W halogen lamp 471 is arranged as the heating heater at the center of the hollow heat roller 474. The surface temperature of the heat roller 474 is detected by the non-contact fixing temperature sensor 473 set at a position separate from the surface of the heat roller 474 by about 0.7 mm, and is controlled by the controller 6 at 190° C.

In this test, the cleaning web (to be merely referred to as web hereinafter) 484 for removing and cleaning the toner remaining on the surface of the fixing temperature sensor 473 after fixing is used. As the web 484, unwoven fabric obtained by forming 0.8- to 1.5-denier fibers made of heat-resistant fibers containing aramid as the main component into a ribbon-like shape with a thickness of 50 $\mu$m to 70 $\mu$m is used.

The cleaning unit 48 has the feed section 482 and take-up section 483 for the cleaning web 484. As copying proceeds (as one recording sheet is conveyed), the cleaning web 484 is fed from the feed section 482 to the take-up section 483.

The backup roller 481 is provided between the feed section 482 and take-up section 483 to abut and press the cleaning web 484 against the heat roller 474. The cleaning web 484 is clamped between the backup roller 481 and heat roller 474. The positions of the axes of the two rollers 481 and 474 are adjusted, and the two rollers 481 and 474 are abutted against each other, such that a nip width of 1 mm to 6 mm can be obtained.

As shown in FIG. 2, the web 484 is pressed by the backup roller 481 against the heat roller 474, and rubs against the surface of the heat roller 474. The web 484 is then taken up by the take-up section 483.

The take-up section 483 is connected to the take-up motor or the like serving as the driving means. Each time one recording sheet is conveyed and copied, the take-up section 483 takes up the web 484 so it is sent for 0.02 mm to 0.8 mm.

The feed section 482 rotates in the same direction as the take-up section 483, so that it supplies the web 484 in an amount corresponding to the amount the cleaning web 484 is wound when the take-up section 483 rotates.

In this case, if the feed section 482 rotates faster than the take-up section 483 due to the inertia or the like, the web 484 slacks, and a feed amount of 0.02 mm to 0.08 mm per conveyance of one recording sheet cannot be obtained at the contact position of the heat roller 474.

For this reason, the brake 488 is attached to the feed section 482, which applies to the feed section 482, as a load torque for the feed section 482, a load (braking) of such a degree that the cleaning web 484 will not slack.

When an inconvenience occurs in the copying operation, the heat roller 474 may be manually rotated in the opposite direction to that of the normal rotation, and the recording sheet left in the copying machine may be removed. In this case, if the braking force for the feed section 482 is low, the web 484 is unwantedly unwound from the feed section 482 by the frictional force between the heat roller 474 and web 484 caused by the pressure of the backup roller 481.

If unwinding of the web 484 continues, the largely slacking web 484 reaches as far as the recording sheet path in the vicinity of the contact portion of the heat roller 474 and press roller 475, to sometimes hinder the recording sheet passing performance.

To prevent this problem, the braking torque for the feed section 482 must be equal to or larger than the frictional force of the heat roller 474 and web 484.

In the embodiment of the present invention, the outermost layer of the heat roller 474 is formed of a fluoroplastic coating layer containing PFA (copolymer of tetrafluoroethylene and perfluoroalkyl vinyl ether) and PTFE (polytetrafluoroethylene) to have a surface roughness Ra of 0.1 $\mu$m to 0.8 $\mu$m and an undulation amount WCM of 1 $\mu$m to 3.5 $\mu$gm. The web 484 is formed of 70-$\mu$m thick unwoven fabric containing aramid as the main component. The backup roller 481 has a backup roller diameter $D_1$ of 10 mm to 30 mm. The resilient layer 481*b*, made of foamed silicone rubber, as the outer layer of the backup roller 481 has a hardness falling within the range of 10° to 40° (measured with an Asker C hardness meter), and its surface has a surface roughness Ra of 20 $\mu$m to 80 $\mu$m.

Assume that the resilient layer 481*b* of the backup roller 481 is to be formed such that when it is squeezed by the heat roller 474, its nip width falls within the range of 1.0 mm to 6.0 mm. In order to prevent the web 484 from being unwantedly unwound from the feed section 482 by the frictional force between the heat roller 474 and web 484 produced upon pressing of the backup roller 481, the feed section 482 must have a braking force of 4 N to 15 N against the web 484.

In this case, when unwinding the web 484 from the feed section 482, a braking force of approximately 4 N to 15 N acts on the web 484 itself as a tensile load.

The take-up section 483 can take up the web 484 only when its take-up force is equal to or larger than the sum of the tensile load produced by the braking force and the frictional force of the heat roller 474 and web 484 produced upon pressure by the backup roller 481 described above. Therefore, the necessary take-up force is approximately 8 N to 30 N as the tensile load for the web 484.

This take-up force (tensile load) must always act while the heat roller 474 rotates, so the web 484 will not be pulled back by the frictional force during rotation of the heat roller 474.

For this purpose, this take-up force (tensile load) acts in a direction to separate the backup roller 481 from the heat roller 474.

Consequently, when the positions of the bearings at the two ends of the backup roller 481 are regulated to obtain the nip width of 1 mm to 6 mm described above, the shaft of the backup roller 481 flexes, and a sufficiently large nip width cannot be obtained at the center of the backup-roller 481 as compared to the axial ends.

Figure 4:
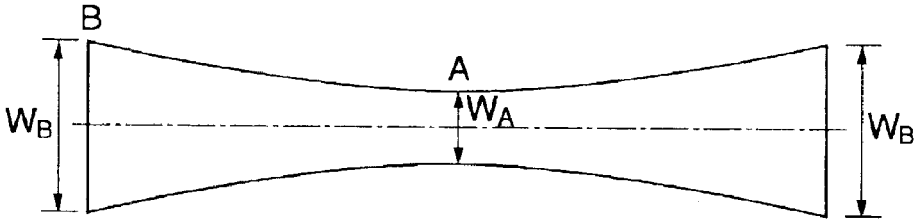
FIG. 4 is a view showing a nip pattern at the contact portion of a backup roller and heat roller.

As shown in FIG. 4, when an axial center A of the backup roller 481 flexes in a direction to separate from the heat roller 474, the nip width of the web 484 and heat roller 474 becomes the nip width $W_B$=5 mm to 6 mm at axial ends B and a nip width $W_A$=1 mm to 2 mm at the axial center A. The difference in nip width between the axial ends B and axial center A of the backup roller 481 is accordingly very large.

As a result, at the axial center, the nip width is small, and the heat roller 474 cannot be sufficiently rubbed by the web 484. The operation of removing the toner attaching to the heat roller 474 weakens, and a large amount of toner tends to remain on the heat roller 474, causing toner contamination on the recording sheet.

At the two ends, since the nip width is large, the toner attaching portion of the web 484 is not sufficiently fed compared to the feed (take-up) amount of the web 484, and the heat roller 474 and the toner attaching surface of the web 484 are in contact with each other for a long period of time. Then, the toner which is scraped by the nip of the web 484 and thus recovered once from the surface of the heat roller 474 shifts to the surface of the heat roller 474 again, easily causing transfer of contamination to the image on the recording sheet.

In order to provide an image forming apparatus in which these troubles are eliminated and which can constantly, stably remove the remaining toner by the web cleaning scheme, the present invention adopts the following measures.

Figure 5:
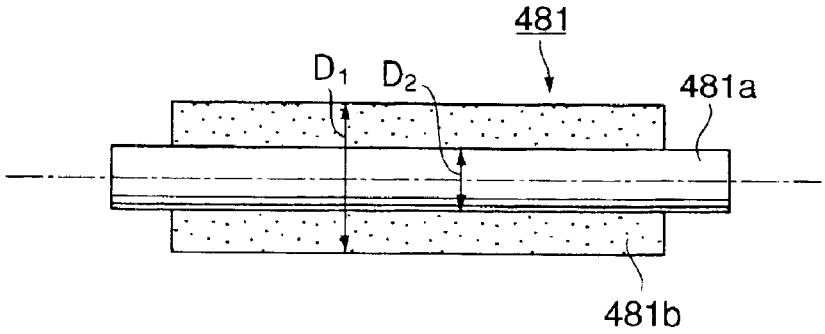
FIG. 5 is a conceptual view of the backup roller.

Referring to FIG. 5, the conventional backup roller 481 for abutting and pressing the web 484 against the heat roller 474 is constituted by two layers of the metal shaft core 481*a* at its center and the resilient layer 481*b* outside the shaft core 481*a*. The resilient layer 481*b* is made of foamed silicone rubber or the like, and has comparatively low hardness and heat resistance.

In this case, the diameter $D_1$ of the backup roller 481 preferably falls within the range of 10 mm to 30 mm and, in the fixing unit of this embodiment, is 15 mm to 20 mm at optimum.

At this time, a diameter $D_2$ of the shaft core 481*a* is preferably 6 mm to 10 mm. If the diameter $D_2$ is less than 6 mm, the strength of the shaft core 481*a* against the tensile force of the web 484 becomes remarkably weak. As a result, the flexure increases, so the axial center of the backup roller 481 presses the cleaning web 484 insufficiently. If the diameter $D_2$ is exceeds 10 mm, the resistance against the tensile force of the web 484 increases naturally. Consequently, although the backup roller 481 will not flex, the heat capacity of the backup roller 481 itself increases, which adversely affects the warm-up time and the power consumption of the fixing heater. Hence, the diameter of the shaft core 481*a* should not be increased excessively, but is 10 mm at maximum.

In this case, the backup roller 481 cannot have a sufficiently large strength against the tensile force of the web 484, as described above, and a difference occurs in the nip width between the axial ends B ($W_B$) and the axial center A ($W_A$), as shown in FIG. 4.

To prevent this, the backup roller 481 is formed to be thin at its two axial ends compared to its axial center, as shown in FIG. 6. Then, even if the backup roller 481 flexes in such a direction that its axial center separates from the heat roller 474, the difference in nip width in the axial direction is small.

Table 1 shows the cleaning abnormality of the remaining toner on the heat roller 474, which occurs when the backup roller 481 flexes.

TABLE 1

| Value of "t" (mm) | Contact Width (Nip Width) (mm) Axial Ends | Axial Center | Trouble |
|---|---|---|---|
| 0 | 5.5 | 1.5 | Discharge of toner occurred at both ends of cleaning web 484 |
| 0.4 | 4.3 | 3.2 | Good |
| 0.7 | 4.1 | 3.8 | Good |
| 1.2 | 3.6 | 4.1 | Good |
| 2 | 2.1 | 4.9 | Passing through of toner occurred at both ends of heat roller 474 |

In Table 1, t=|diameter of axial center|−| diameter of axial end|, and shaft core diameter $D_2$=8 mm.

When the cleaning characteristics are examined by changing the value of t, when the value of t falls within the range of 0.4 to 1.2, no abnormality occurs, so this range is effective. If the value of t exceeds the upper limit of this range, the contact at the axial ends becomes weak, and toner passes through without being not cleaned up at both the axial ends of the heat roller 474. As the toner, one containing a thermoplastic styrene-acrylic resin having an average particle size of 7 μm or less as the main component is used.

From the above description, the difference in diameter between the center and the two ends is 0.1 mm to 2 mm, and is preferably 0.4 mm to 1.2 mm with which abnormalities are few.

The backup roller 481 used in this test has the shape shown in FIG. 6, in which the line connecting the axial ends and the projection at the axial center forms a straight line. Alternatively, the backup roller 481 may have a hyperbolic shape (crown-like shape) the gradient of which decreases toward the axial center.

The resilient layer 481*b* as the outer layer has such a shape that its thickness is small at its two ends and large at its center. Alternatively, if the resilient layer 481*b* has a constant thickness but the shaft core 481*a* projects at its axial center, as shown in FIG. 7, the same effect can be obtained.

In this case, the diameters at the two ends of the shaft core 481*a* can be smaller than the shaft core diameter $D_2$ of the backup roller 481 shown in FIG. 6.

What is claimed is:

1. An electrophotographic image forming apparatus, comprising:

a fixing device having a heat roller and a press roller which abuts against and presses said heat roller, and at least one cleaning device having a backup roller which abuts against and presses said heat roller in order to remove remaining toner attaching to a surface of the heat roller, wherein said backup roller has a two-layer structure of a metal shaft core and a resilient layer, as an outer layer for said shaft core, made of a resilient body, a diameter of said backup roller gradually decreasing from a projecting axial center toward two axial ends, so that an entire outer shape of the backup roller forms a crown or spindle shape, wherein the cleaning device comprises a cleaning web converted between the backup roller and the heat roller to come into slidable contact therewith, a feed device for supplying the cleaning web, and a take-up device for recovering the cleaning web, and wherein said shaft core of said backup roller is a circular cylindrical shaft with a diameter of 5 mm to 15 mm which is made of iron, SUS (stainless steel), or aluminum, and said resilient layer of said backup roller is made of a resilient body containing silicone foamed rubber and having a surface roughness Ra of 20 μm to 80 μm, a hardness of 10 to 40 degrees (Asker C hardness), and a thickness of 3 mm to 20 mm, such that a thickness of said resilient layer around said shaft core is uniform in a direction of diameter, and is large at the axial center and gradually decreases toward the two axial ends in an axial direction, so a difference t in thickness between the axial center and the two axial ends is 0.05 mm to 1 mm.

2. An apparatus according to claim 1, wherein the diameter of the backup roller gradually decreases from the projecting axial center of 10 mm to 30 mm toward two axial ends.

3. An electrophotographic image forming apparatus, comprising:

a fixing device having a heat roller and a press roller which abuts against and presses said heat roller, and at least one cleaning device having a backup roller which abuts against and presses said heat roller in order to remove remaining toner attaching to a surface of the heat roller, wherein said backup roller has a two-layer structure of a metal shaft core and a resilient layer, as an outer layer for said shaft core, made of a resilient body, a diameter of said backup roller gradually decreasing from a projecting axial center toward two axial ends, so that an entire outer shape of the backup roller forms a crown or spindle shape, wherein the cleaning device comprises a cleaning web converted between the backup roller and the heat roller to come into slidable contact therewith, a feed device for supplying the cleaning web, and a take-up device for recovering the cleaning web, and wherein said shaft core of said backup roller is made of iron, SUS (stainless steel), or aluminum, a diameter of said shaft core gradually decreasing from the projecting axial center of 5 mm to 15 mm toward the two axial ends, to form a crown or spindle like shape with a difference in diameter between the axial center and the two axial ends of 0.1 mm to 2 mm, and said resilient layer of said backup roller is made of a resilient body containing silicone foamed rubber and having a surface roughness a of 20 m to 80 $\mu$m, a hardness of 10 to 40 degrees (Asker C hardness), and a thickness of 3 mm to 20 mm, such that a thickness or said resilient layer is substantially uniform both in a direction of diameter and in an axial direction.

4. An apparatus according to claim 3, wherein the diameter of the backup roller gradually decreases from the projecting axial center of 10 mm to 30 mm toward two axial ends.

5. An electrophotographic image forming apparatus, comprising:

a fixing device having heat roller and a press roller which abuts against and presses said heat roller, and at least one cleaning device having a backup roller which abuts against and presses said heat roller in order to remove remaining toner attaching to a surface of the heat roller, wherein said backup roller has a two-layer structure of a metal shaft core and a resilient layer, as an outer layer for said shaft core, made of a resilient body, a diameter of said backup roller gradually decreasing from a projecting axial center toward two axial ends, so that an entire outer shape of the backup roller forms a crown or spindle shape, and wherein said cleaning device comprises a cleaning web conveyed between said backup roller and said heat roller to come into slidable contact therewith, in order to remove remaining toner attaching to the surface of said heat roller, a feed device for supplying said cleaning web, and a take-up device for recovering said cleaning web, said cleaning web comprising a ribbon like web made of fibers including an aramid fiber, and said feed device being connected to a brake which generates a braking force of 4 N to 15 N for said cleaning web.

6. An apparatus according to claim 5, wherein said heat roller and said backup roller rub against said cleaning web with a peripheral velocity of 150 mm/sec to 400 mm/sec.

7. An apparatus according to claim 5, wherein the diameter of the backup roller gradually decreases from the projecting axial center of 10 mm to 30 mm toward two axial ends.

8. An electrophotographic image forming apparatus, comprising:

a fixing device having a heat roller and a press roller which abuts against and presses said heat roller, and at least one cleaning device having a backup roller which abuts against and presses said heat roller in order to remove remaining toner attaching to a surface of the heat roller, wherein said backup roller has a two-layer structure of a metal shaft core and a resilient layer, as an outer layer for said shaft core, made of a resilient body, a diameter of said backup roller gradually decreasing from a projecting axial center toward two axial ends, so that an entire outer shape of the backup roller forms a crown or spindle shape, wherein the cleaning device comprises a cleaning web converted between the backup roller and the heat roller to come into slidable contact therewith, a feed device for supplying the cleaning web, and take-up device for recovering the cleaning web, and wherein said backup roller and said heat roller are disposed at such an axis to axis distance from each other that a nip width formed when said backup roller and said heat roller abut against each other is 1 mm to 6 mm.

9. An apparatus according to claim 8, wherein the diameter of the backup roller gradually decreases from the projecting axial center of 10 mm to 30 mm toward two axial ends.

10. An electrophotographic image forming apparatus, comprising:

a fixing device having a heat roller and a press roller which abuts against and presses said heat roller, and at least one cleaning device having a backup roller which abuts against and presses said heat roller in order to remove remaining toner attaching to a surface of the heat roller, wherein said backup roller has a two-layer structure of a metal shaft core and a resilient layer, as an outer layer for said shaft core, made of a resilient body, a diameter of said backup roller gradually decreasing from a projecting axial center toward two axial ends, so that an entire outer shape of the backup roller forms a crown or spindle shape, wherein the cleaning device comprises a cleaning web converted between the backup roller and the heat roller to come into slidable contact therewith, a feed device for supplying the cleaning web, and a take-up device for recovering the cleaning web, and wherein an outermost layer of said heat roller is formed of a fluoroplastic coating layer containing a copolymer (PFA) of tetrafluoroethylene and perfluoroalkyl vinyl ether and polytetrafluoroethylene (PTFE) and has a surface roughness Ra of 0.1 $\mu$m to 0.8 $\mu$m and an undulation amount WCM of 1 $\mu$m to 3.5 $\mu$m.

11. An apparatus according to claim 10, wherein the diameter of the backup roller gradually decreases from the projecting axial center of 10 mm to 30 mm toward two axial ends.

12. An electrophotographic image forming apparatus comprising a fixing device having a heat roller and a press roller which abuts against and presses said heat roller and a control device, wherein the apparatus further comprises at least one cleaning device having a backup roller which abuts against and presses said heat roller in order to remove remaining toner attaching to a surface of said heat roller, said backup roller has a two layer structure of a metal shaft core with a diameter of 5 mm to 15 mm and a resilient layer, as an outer layer for said shaft core, made of a resilient body containing foamed rubber, said resilient layer having a hardness of 10 to 40 degrees (measured by an Asker C hardness meter) and a surface roughness Ra of 20 $\mu$m to 80 $\mu$m, a diameter of said backup roller gradually decreasing from a projecting axial center of 10 mm to 30 mm toward two axial ends, so that an entire outer shape of said backup roller forms a crown or spindle like shape with a difference in diameter between the axial center and the two axial ends of 0.1 mm to 2 mm, and said cleaning device comprises a ribbon like cleaning web which is made of fibers including an aramid fiber and conveyed between said backup roller and said heat roller to come into slidable contact therewith under a pressure in order to scrape off the remaining toner attaching to said heat roller, a feed device for supplying said cleaning web, and a take-up device driven by a driving device controlled by said control device to recover said cleaning web, said driving device being controlled by said control device to generate a winding force of 8 N to no greater than 30 N, when said heat roller rotates in a forward direction, in a direction opposite to a rotating direction of said heat roller in accordance with a cleaning web width.

13. An apparatus according to claim 12, wherein said control device controls said driving device such that said cleaning web is conveyed for 0.02 mm to 0.08 mm whenever a piece of recording medium is conveyed.

14. A control method in an electrophotographic image forming apparatus comprising a fixing device having a heat roller and a press roller which abuts against and presses said heat roller, and a cleaning device, having a backup roller which abuts against and presses said heat roller, for conveying a cleaning web, serving to scrape off remaining toner attaching to a surface of said heat roller, between said heat roller and said backup roller to be in slidable contact therewith under a pressure, wherein the method comprises the steps of:

conveying said cleaning web between said heat roller and said backup roller for 0.02 mm to 0.08 mm at a peripheral velocity of 150 mm/sec to 400 mm/sec whenever a piece of recording medium is conveyed, so that an image is to be formed on the recording medium, and applying a winding force of 8 N to no greater than 30 N to said cleaning web in a direction opposite to a rotating direction of said heat roller in accordance with a width of said cleaning web.

* * * * *